US009285159B2

(12) United States Patent
Kim

(10) Patent No.: US 9,285,159 B2
(45) Date of Patent: Mar. 15, 2016

(54) REFRIGERATOR AND DISPENSER FOR REFRIGERATOR

(75) Inventor: Pansoo Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1173 days.

(21) Appl. No.: 12/986,235

(22) Filed: Jan. 7, 2011

(65) Prior Publication Data

US 2011/0174008 A1 Jul. 21, 2011

(30) Foreign Application Priority Data

Jan. 18, 2010 (KR) ..... 10-2010-0004524

(51) Int. Cl.
*F25D 23/12* (2006.01)
*F25D 27/00* (2006.01)

(52) U.S. Cl.
CPC ..... *F25D 23/126* (2013.01); *F25D 27/00* (2013.01)

(58) Field of Classification Search
CPC ..... F25D 27/00; F25D 27/005
USPC ..... 62/264, 389–400
See application file for complete search history.

(56) References Cited

U.S. PATENT DOCUMENTS 4,851,662 A * 7/1989 Ott et al. ..... 250/214 AL
2004/0179350 A1 9/2004 Ortega
2005/0044871 A1* 3/2005 Nowak ..... 62/264
2007/0044497 A1* 3/2007 Roo et al. ..... 62/264
2008/0163641 A1* 7/2008 Mitchell ..... 62/389
2009/0284157 A1* 11/2009 Wetekamp ..... 315/154
2012/0180517 A1* 7/2012 Filho et al. ..... 62/389

FOREIGN PATENT DOCUMENTS

| | | | |
|---|---|---|---|
| CN | 1959316 | A | 5/2007 |
| CN | 200972301 | Y | 11/2007 |
| CN | 101231128 | A | 7/2008 |
| CN | 101511721 | A | 8/2009 |
| KR | 10-2006-0062146 | A | 6/2006 |
| KR | 10-2007-0077943 | A | 7/2007 |
| KR | 20-2008-0005808 | U | 12/2008 |
| WO | WO 2008/028780 | A1 | 3/2008 |

OTHER PUBLICATIONS

Chinese Office Action dated Dec. 21, 2012 for Application No. 20110020119.1, in English, 11 pages.

* cited by examiner

*Primary Examiner* — Judy Swann
*Assistant Examiner* — Zachary R Anderegg
(74) *Attorney, Agent, or Firm* — Fish & Richardson P.C.

(57) ABSTRACT

There are provided a refrigerator and a dispenser for the refrigerator. A light emitting unit is provided to emit light toward manipulation member of the dispenser so that the dispenser can be conveniently used and have a better aesthetic appearance.

11 Claims, 9 Drawing Sheets

REFRIGERATOR AND DISPENSER FOR REFRIGERATOR

CROSS-REFERENCE TO RELATED APPLICATIONS

The present application claims priority under 35 U.S.C. 119 and 35 U.S.C. 365 to Korean Patent Application No. 10-2010-0004524 (Jan. 18, 2010), which is hereby incorporated by reference in its entirety.

BACKGROUND

The present disclosure relates to a refrigerator and a dispenser for the refrigerator.

A refrigerator is a home appliance providing a low-temperature storage that can be opened and closed by a door for storing foods at a low temperature. The storage of the refrigerator is cooled by using air which is cooled by heat exchange with a refrigerant in refrigeration cycles.

Along with the change of people's eating patterns and preference, large and multifunctional refrigerators have been introduced, and various comfortable structures have been added to refrigerators.

For example, some of recent refrigerators are equipped with dispensers so that a user can get ice made in the refrigerator without having to open the door of the refrigerator. Such a dispenser is provided on the outer side of a door of a refrigerator, and a user can get ice made by an ice maker disposed in the refrigerator by manipulating the dispenser at the outside of the refrigerator.

Generally, the dispenser includes a recess formed inwardly from the front side of the door. Ice can be received by placing a cup or bowl in the recess and manipulating a button or lever.

SUMMARY

In one embodiment, there is provided a dispenser for a refrigerator, the dispenser including: a dispenser case forming a recess in a door of the refrigerator; a manipulation member disposed at the dispenser case so that a user receives ice or water by manipulating the manipulation member; and a first light emitting unit disposed at the dispenser case to emit light toward the manipulation member.

In another embodiment, a refrigerator includes: a cabinet providing a storage space; a door used to close and open the storage space; a dispenser disposed at the door for dispensing water or ice; a manipulation member at least a part of which is spaced apart from a recessed inner surface of the dispenser so as to be manipulated for receiving water or ice; a first light emitting unit disposed between the inner surface of the dispenser and the manipulation member to emit light, and a second light emitting unit disposed at a side of the dispenser to emit light toward an inside of the dispenser.

In further another embodiment, a refrigerator includes a dispenser disposed at a front side of a door used to close and open a storage space, the dispenser dispensing water or ice according to a user's manipulation, wherein the dispenser includes: a manipulation member at least a part of which is spaced apart from a recessed inner surface of the dispenser so as to be manipulated for receiving water or ice; and a first light emitting unit disposed between the inner surface of the dispenser and the manipulation member to emit light.

The first light emitting unit may be disposed at a rear side of the manipulation member to emit light toward a rear surface of the manipulation member.

The manipulation member may include a rotatable level.

The dispenser may include a dispenser case providing a recessed space in the front side of the door, and the dispenser case may include a recessed mounting part to accommodate the first light emitting unit.

The first light emitting unit may include: a light emitting unit case disposed at the dispenser; an LED module disposed in the light emitting unit case and including an LED; a light emitting unit cover configured to close an opened side of the light emitting unit case and transmit light emitted from the LED; and a waterproof agent filled in the light emitting unit case.

The light emitting unit cover may include a protrusion configured to accommodate an end part of the LED and disperse light emitted from the LED.

The manipulation member may include a transparent part through which light emitted from the first light emitting unit may be transmitted.

A reflection part may be provided on a rear surface of the manipulation member to reflect light emitted from the first light emitting unit.

The refrigerator may further include a second light emitting unit disposed at a side of the dispenser to emit light toward an inside of the dispenser.

The second light emitting unit may be configured to emit light toward a bottom of the dispenser.

The second light emitting unit may be disposed at an inner upper surface of the dispenser.

The second light emitting unit may be turned on when the manipulation member may be manipulated.

The manipulation member may be manipulated, the first light emitting unit may be turned off, and the second light emitting unit may be turned on.

A button may be provided at the dispenser for turning on or off the first light emitting unit by manipulating the button.

The first light emitting unit may be automatically turned on and off according to a set time or an intensity of illumination of an indoor area.

In still further another embodiment, a refrigerator includes: a cabinet providing a storage space; a door used to close and open the storage space; a dispenser disposed at the door for dispensing water or ice; a manipulation member at least a part of which is spaced apart from a recessed inner surface of the dispenser so as to be manipulated for receiving water or ice; and a first light emitting unit disposed between the inner surface of the dispenser and the manipulation member to emit light.

The first light emitting unit may be disposed at a rear side of the manipulation member to emit light toward a rear surface of the manipulation member.

The manipulation member may include a rotatable level.

The dispenser may include a dispenser case providing a recessed space in the front side of the door, and the dispenser case may include a recessed mounting part to accommodate the first light emitting unit.

The first light emitting unit may include: a light emitting unit case disposed at the dispenser; an LED module disposed in the light emitting unit case and including an LED; a light emitting unit cover configured to close an opened side of the light emitting unit case and transmit light emitted from the LED; and a waterproof agent filled in the light emitting unit case.

The light emitting unit cover may include a protrusion configured to accommodate an end part of the LED and disperse light emitted from the LED.

The manipulation member may include a transparent part through which light emitted from the first light emitting unit may be transmitted.

A reflection part may be provided on a rear surface of the manipulation member to reflect light emitted from the first light emitting unit.

The refrigerator may further include a second light emitting unit disposed at a side of the dispenser to emit light toward an inside of the dispenser.

The second light emitting unit may be configured to emit light toward a bottom of the dispenser.

The second light emitting unit may be disposed at an inner upper surface of the dispenser.

The second light emitting unit may be turned on when the manipulation member may be manipulated.

The manipulation member may be manipulated, the first light emitting unit may be turned off, and the second light emitting unit may be turned on.

A button may be provided at the dispenser for turning on or off the first light emitting unit by manipulating the button.

The first light emitting unit may be automatically turned on and off according to a set time or an intensity of illumination of an indoor area.

The details of one or more embodiments are set forth in the accompanying drawings and the description below. Other features will be apparent from the description and drawings, and from the claims.

BRIEF DESCRIPTION OF THE DRAWINGS

FIG. 8 is a view illustrating a state of the dispenser when the first light emitting unit is turned on.

FIG. 9 is a view illustrating a state of the dispenser when the second light emitting unit is turned on.

DETAILED DESCRIPTION OF THE EMBODIMENTS

Reference will now be made in detail to embodiments of the present disclosure, examples of which are illustrated in the accompanying drawings. The present disclosure may, however, be embodied in many different forms and should not be construed as being limited to the embodiments set forth herein.

In the following descriptions of embodiments, explanations are given in the case where a dispenser is provided at a bottom freezer type refrigerator in which a freezer compartment is disposed under a refrigerator compartment. However, the inventive concept of the present disclosure can be applied to all kinds of refrigerators which include a dispenser.

Figure 1:
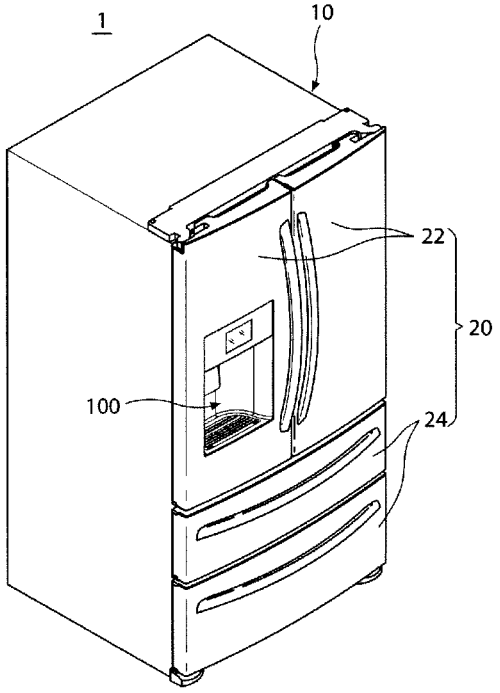
FIG. 1 is a perspective view illustrating of a refrigerator according to an embodiment.

FIG. 1 is a perspective view illustrating of a refrigerator 1 according to an embodiment.

Referring to FIG. 1, the outside of the refrigerator 1 of the current embodiment is formed by a cabinet 10 in which a storage space is formed and a door 20 used to open and close the storage space.

The storage space is divided into an upper refrigerator compartment and a lower freezer compartment. The door 20 may include refrigerator compartment doors 22 and freezer compartment doors 24.

A dispenser 100 is provided at one of the refrigerator compartment door pair 22. The dispenser 100 is configured such that purified water or ice made in the refrigerator 1 can be taken through the dispenser 100. The dispenser 100 will be described later in more detail.

The refrigerator compartment doors 22 are provided as a pair. The pair of refrigerator compartment doors 22 are configured to be opened and closed by rotating them at the front left or light side of the refrigerator compartment. The freezer compartment doors 24 are provided as a pair. The freezer compartment doors 24 have a pull-push drawer shape, and thus the freezer compartment can be opened and closed by pulling and pushing the freezer compartment doors 24.

The freezer compartment is divided into upper and lower parts, and the upper and lower parts can be individually opened and closed by using the pair of freezer compartment doors 24. Alternatively, the freezer compartment may not be divided into parts, and in this state, the freezer compartment may be opened and closed by using the pair of freezer compartment doors 24.

Figure 2:
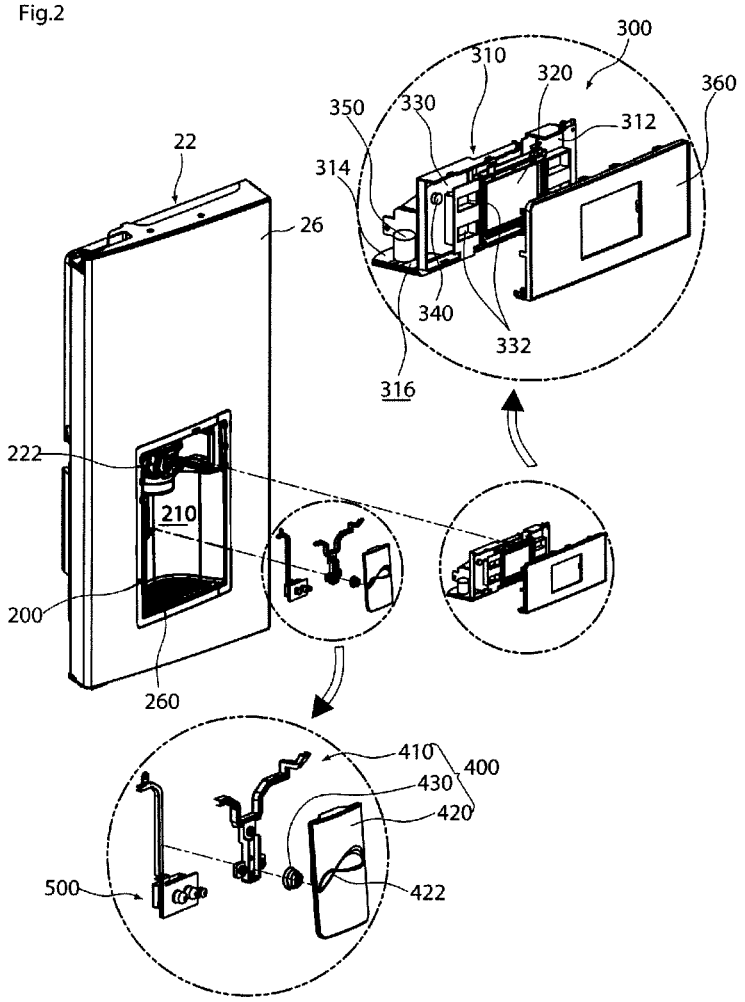
FIG. 2 is an exploded perspective view illustrating a dispenser according to an embodiment.
Figure 3:
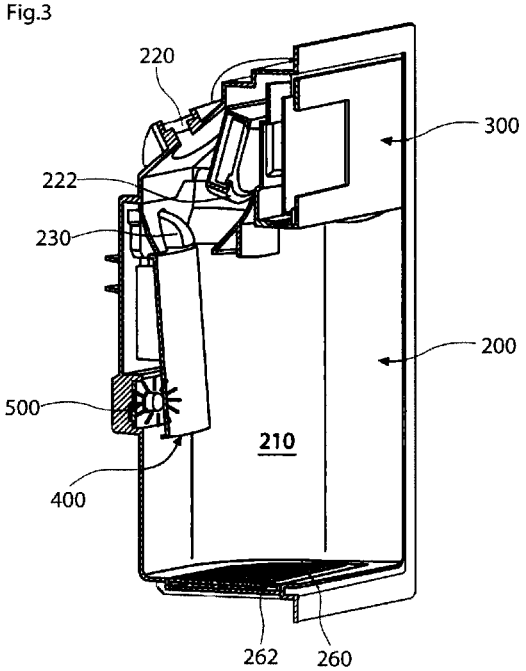
FIG. 3 is a cut-away view illustrating the dispenser.
Figure 4:
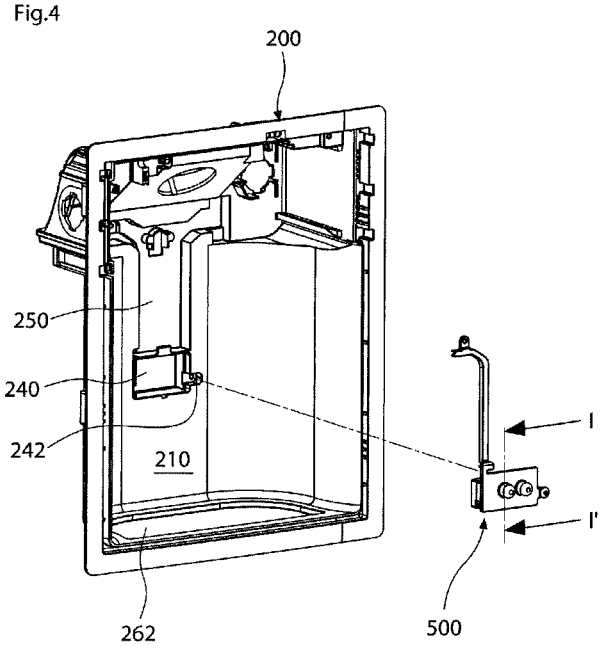
FIG. 4 is a view illustrating a first light emitting unit disposed on a dispenser case according to an embodiment.

FIG. 2 is an exploded perspective view illustrating the dispenser 100 according to an embodiment, and FIG. 3 is a cut-away view illustrating the dispenser 100. FIG. 4 is a view illustrating a first light emitting unit 500 disposed on a dispenser case 200 according to an embodiment.

Referring to FIGS. 2 to 4, the dispenser 100 is disposed in an outer case 26 of the refrigerator compartment door 22. The dispenser 100 includes the dispenser case 200 forming the outside of the dispenser 100, an ice chute 220 through which ice is taken to the outside, a wafer supply pipe 230 through which wafer is supplied to the outside, a manipulation member 400 used when taking out ice, and a display assembly 300 configured to display manipulation and operation states of the dispenser 100.

In detail, the dispenser case 200 forms the outside of the dispenser 100 and includes a recess 210 recessed inward from the refrigerator compartment door 22. When receiving water or ice from the dispenser 100, a cup or a bowl may be placed in the recess 210. For this, the recess 210 is recessed inward from the refrigerator compartment door 22.

The dispenser case 200 is disposed inside the refrigerator compartment door 22. The front side of the dispenser case 200 may be placed on the same plane as the outer case 26. The inside of the dispenser case 200 is configured so that a plurality of parts of the dispenser 100 can be placed.

The ice chute 220 is disposed on the topside of the dispenser case 200. The ice chute 220 communicates with a passage through which ice is discharged from the inside of the refrigerator 1. The ice chute 220 extends downward from the topside of the dispenser case 200, and an opened end of the ice chute 220 is exposed to the inside of the recess 210.

A chute cover 222 is disposed at the opened end of the ice chute 220 to close and open the opened end of the ice chute 220. The chute cover 222 is rotatable disposed at the ice chute 220 so that the opened end of the ice chute 220 can be opened and closed by using the chute cover 222. The chute cover 222 may be mechanically or electrically opened or closed by manipulating the manipulation member 400.

The wafer supply pipe 230 is provided at the lower side of the ice chute 220. Purified water may be received through the wafer supply pipe 230. For this, the wafer supply pipe 230 may be disposed to penetrate the dispenser case 200, and an end of the wafer supply pipe 230 may be exposed to the inside of the recess 210.

The display assembly 300 is disposed at an upper side of the dispenser case 200. The display assembly 300 may include a base 310, a display 320, a manipulation unit 330, and a cover plate 360.

The base 310 is disposed at the upper side of the dispenser case 200 to dispose the display 320 and the manipulation unit 330 at the base 310. The base 310 is configured such that the display 320 and the manipulation unit 330 are placed at the front side of the refrigerator compartment door 22 when the display 320 and the manipulation unit 330 are disposed at the base 310. The ice chute 220 and the chute cover 222 may be disposed at the backside of the base 310. The display 320 and the manipulation unit 330 are provided at the front side of the base 310.

At a front surface 312 of the base 310, the display 320 and the manipulation unit 330 provided. Various devices such as a liquid crystal display may be used as the display 320 for displaying operational information of the refrigerator 1 and the dispenser 100. The display 320 is disposed at the center part of the base 310.

The manipulation unit 330 may include a plurality of buttons 332 for manipulating the refrigerator 1 and the dispenser 100, and a printed circuit board for operations according to manipulations input through the buttons 332. The buttons 332 may be mechanical push buttons or touch buttons.

If necessary, a touch screen display may be used as the display 320 to manipulate the refrigerator 1 and the dispenser 100 without the manipulation unit 330.

A detection sensor 340 may be disposed at the base 310. The detection sensor 340 may be used to detect the intensity of illumination of an indoor area for determining on-off operations of a first light emitting unit 500 (described later). The detection sensor 340 may be disposed on the front surface of the base 310. Alternatively, the detection sensor 340 may be disposed at another part of the refrigerator 1 than the base 310 as long as the intensity of illumination of an indoor area can be detected. If necessary, a proximity sensor or an infrared sensor capable of detecting the position of a user may be used as the detection sensor 340.

A second light emitting unit 350 may be disposed at a bottom surface 314 of the base 310. The second light emitting unit 350 may emit light downward from the bottom surface 314 of the base 310 to illuminate the inside of the dispenser 100.

The second light emitting unit 350 may emit light through an opening 316 of the bottom surface 314 of the base 310. The second light emitting unit 350 may be a module including at least one light emitting diode (LED). The second light emitting unit 350 may be disposed in an additional waterproof case.

The opening 316 may be formed in the bottom surface 314 of the base 310 at a position spaced apart from the center of the bottom side of the base 310. In this case, the second light emitting unit 350 may be positioned to emit light toward the center of the bottom surface of the dispenser 100.

The second light emitting unit 350 is electrically connected to a control unit 600 (not shown) and is turned on when water or ice is received by manipulating the manipulation member 400 or a bowl is placed in the recess 210. Thus, since the inside of a cup or a bowl place in the recess 210 can be illuminated, the receiving state of water or ice can be checked.

After the manipulation member 400 is manipulated, the second light emitting unit 350 is turned off. Alternatively, the second light emitting unit 350 may be turned on or off according to detection of the detection sensor 340 or settings input through the buttons 332.

The cover plate 360 forms the front surface of the display assembly 300 and may be placed on the same plane as the refrigerator compartment door 22. Parts of the cover plate 360 corresponding to the dispenser 100, the buttons 332, and the detection sensor 340 may be opened or marked.

The manipulation member 400 is disposed under the display assembly 300. The manipulation member 400 may be manipulated for receiving water or ice, and for this, the manipulation member 400 may have a lever-like structure.

An upper end of the manipulation member 400 is shaft-coupled so that the manipulation member 400 can be rotated. When the manipulation member 400 is pressed, the manipulation member 400 is rotated to turn on or off a switch (not shown) which generates an operation signal for supplying water or ice. Water or ice is supplied according to the on or off state of the switch.

The manipulation member 400 is disposed approximately at the center part of the recess 210. The manipulation member 400 is disposed along the same line as the wafer supply pipe 230 and the ice chute 220 so that when the manipulation member 400 is pushed by a cup or a bowl, water or ice can be supplied to the cup or bowl.

The manipulation member 400 includes a manipulation lever 410 which is rotatable to turn on or off the switch, and a paddle 420 configured to be brought into contact with a cup or a bowl.

Upper ends of the manipulation lever 410 are rotatably coupled to an upper part of the dispenser case 200 or a bottom surface of the base 310. The switch is disposed at a side of the manipulation lever 410 so that the switch may be turned on when the manipulation lever 410 is rotated against the switch by a pushing force.

The manipulation lever 410 is elastically supported by a spring 430 so that the manipulation lever 410 can be rotated back to its original position if the pushing force acting on the manipulation lever 410 is removed. Then, the switch can be turned off.

The paddle 420 is disposed on the manipulation lever 410. The paddle 420 is configured to be rotated together with the manipulation lever 410 and may have a predetermined area for easy contact with a cup or a bowl. The paddle 420 may extend to a predetermined length to completely cover a mounting part 240 on which the first light emitting unit 500 is disposed. In this case, light emitting from the first light emitting unit 500 may be directed to the backside of the paddle 420.

In addition, the front surface of the paddle 420 may be curved so that the paddle 420 can make contact with a cup or a bowl more easily for rotating the manipulation lever 410.

The manipulation member 400 may be formed of a metal material that reflects light well, or a plastic member the backside of which is coated with a reflective layer. In this case, light emitted from the first light emitting unit 500 toward the backside of the manipulation member 400 can be effectively reflected to make the surrounding area of the manipulation member 400 brighter or provide various lighting effects at the surrounding area of the manipulation member 400.

In addition, the manipulation member 400 may include a transparent part 422 which is transparent or semitransparent. A part of light emitted from the first light emitting unit 500 may be transmitted through the transparent part 422 to form a predetermined pattern or character.

The mounting part 240 (described later in more detail) is provided at the center part of the recess 210 to dispose the first light emitting unit 500 in the recess 210. The recess 210 is formed into a shape corresponding to the shape of the first light emitting unit 500 so that the first light emitting unit 500 can be disposed in the recess 210. A fastener coupling part 242 may be recessed at a side of the recess 210 for coupling with a coupling member 540 such as a screw.

A manipulation member accommodation part 250 may be recessed at an upper side of the recess 210 to provide a space in which the manipulation member 400 can be rotated when the manipulation member 400 is manipulated.

A bottom plate 260 may be provided at the bottom side of the dispenser case 200. The bottom plate 260 may have a grill shape. The bottom plate 260 may be formed of a material such as rubber or urethane so that a cup or a bowl placed on the bottom plate 260 cannot be slipped.

The bottom plate 260 may be detachably disposed. A bottom plate mounting part 262 may be provided at the bottom side of the dispenser case 200 to dispose the bottom plate 260 at the bottom plate mounting part 262. The bottom plate mounting part 262 may be shaped to receive water falling when the dispenser 100 is manipulated. In addition, a part of the bottom side of the dispenser case 200 may be detachably provided to detach the part when water collected in the bottom plate mounting part 262 is discarded.

Figure 5:
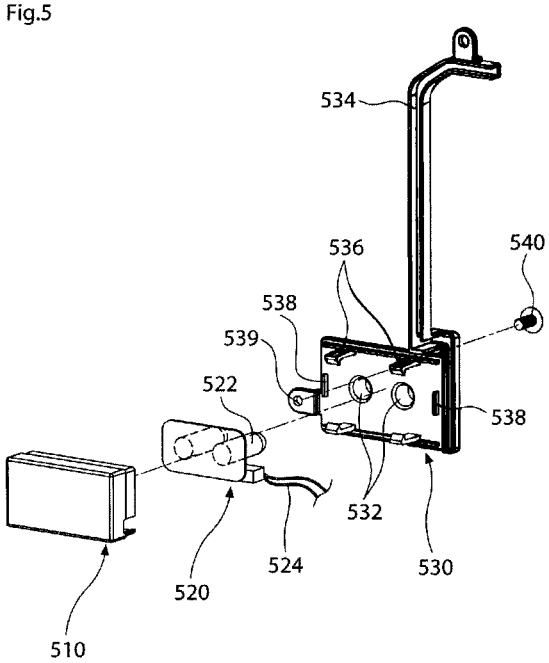
FIG. 5 is an exploded perspective view illustrating the backside of the first light emitting unit.
Figure 6:
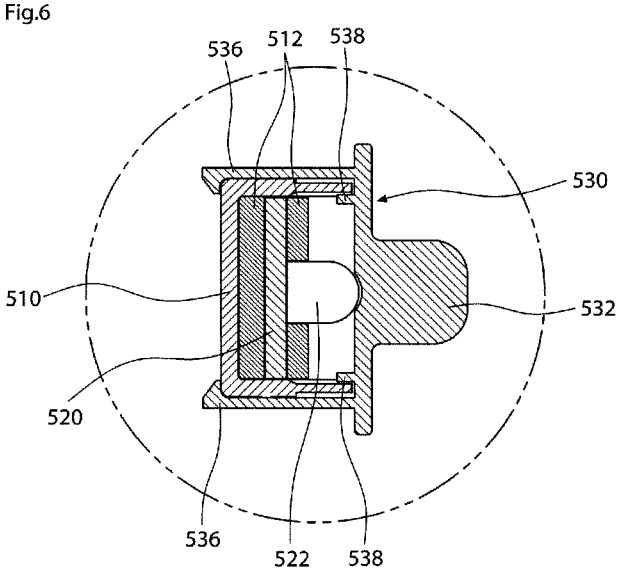
FIG. 6 is a sectional view taken along line I-I' of FIG. 4.

FIG. 5 is an exploded perspective view illustrating the backside of the first light emitting unit 500. FIG. 6 is a sectional view taken along line I-I' of FIG. 4.

The first light emitting unit 500 will described in more detail with reference to FIGS. 5 and 6.

Referring to FIGS. 5 and 6, the first light emitting unit 500 may include a light emitting unit case 510 forming the outside of the first light emitting unit 500, an light emitting diode (LED) module 520 configured to emit light, and a light emitting unit cover 530 configured to cover the light emitting unit case 510.

In detail, the light emitting unit case 510 forms the outside of the first light emitting unit 500 and has a shape corresponding to the shape of the mounting part 240 of the recess 210 so that the light emitting unit case 510 can be inserted in the mounting part 240. The front side of the light emitting unit case 510 is opened, and a space is formed in the light emitting unit case 510 to receive the LED module 520.

The LED module 520 includes a circuit board on which LEDs 522 are disposed. The LED module 520 is disposed in the light emitting unit case 510. A plurality of LEDs 522 are provided in the LED module 520, and the LEDs 522 can be disposed to protrude forwardly.

In a state where the LED module 520 is disposed in the light emitting unit case 510, a waterproof agent 512 is filled in the light emitting unit case 510. The waterproof agent 512 prevents permeation of water or moisture into the LED module 520. The waterproof agent 512 may include an epoxy resin or silicon. The waterproof agent 512 may enclose the LEDs 522 but may not enclose the LEDs 522 completely so as not to block light emitted from the LEDs 522.

The light emitting unit cover 530 is shaped to cover the opened front side of the light emitting unit case 510. The light emitting unit cover 530 may be transparent or semitransparent to transmit light emitted from the LEDs 522. The light emitting unit cover 530 may have a predetermined color. In this case, light emitted through the light emitting unit cover 530 has the same color as the predetermined color.

Protrusions 532 are provided at the light emitting unit cover 530. The protrusions 532 are disposed at positions corresponding to the positions of the LEDs 522 and are forwardly projected. Therefore, light emitted from the first light emitting unit 500 may be distributed through the protrusions 532. The insides of the protrusions 532 may be recessed, and in this case, at least parts of the LEDs 522 may be disposed in the recessed insides of the LEDs 522.

In addition, a wire guide part 534 is provided at the light emitting unit cover 530. The wire guide part 534 extends upward from an upper end of the light emitting unit cover 530, and a guide groove is formed in the wire guide part 534 to guide wires 524 connected to the LED module 520. The wire guide part 534 may be disposed along the manipulation member accommodation part 250 of the dispenser case 200. The guide wires 524 may be guided along the wire guide part 534 and connected through the dispenser case 200 to the control unit 600 that controls operations of the dispenser 100.

A plurality of coupling parts 536 are provided on the upper and lower parts of the light emitting unit cover 530. Ends of the coupling parts 536 are hook-shaped and extended so that the rear side of the light emitting unit case 510 can be hooked by the coupling parts 536.

In addition, guide ribs 538 may be disposed at both sides of the rear surface of the light emitting unit cover 530. When the light emitting unit cover 530 is coupled with the light emitting unit case 510, the guide ribs 538 makes contact with inner surfaces of the light emitting unit case 510. Therefore, owing to the guide ribs 538, the light emitting unit cover 530 can be easily disposed in position.

In addition, a fixing part 539 is disposed at a lateral end of the light emitting unit cover 530. When the first light emitting unit 500 is mounted, the fixing part 539 is inserted in the fastener coupling part 242. Thus, the fixing part 539 has a shape corresponding to the shape of the fastener coupling part 242. Then, a coupling member 540 is inserted in the fixing part 539. The coupling member 540 is coupled to the fastener coupling part 242 through the fixing part 539 to fix the first light emitting unit 500.

Hereinafter, operations of the refrigerator 1 and the dispenser 100 will be described according to embodiments.

Figure 7:
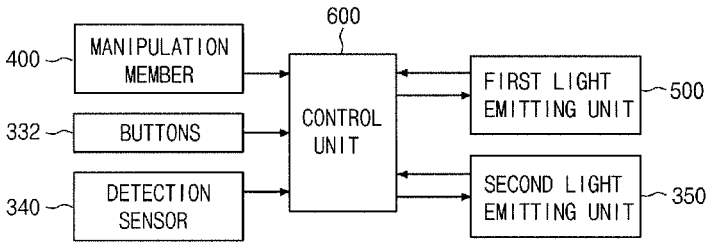
FIG. 7 is a block diagram illustrating signal flows for driving first and second light emitting units according to an embodiment.
Figure 8:
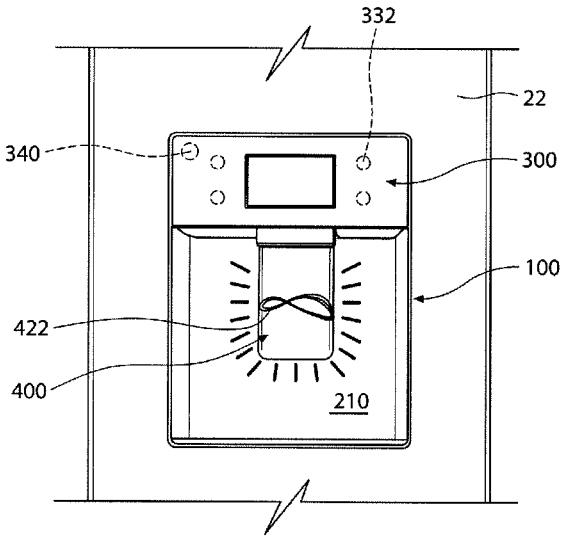
Figure 9:
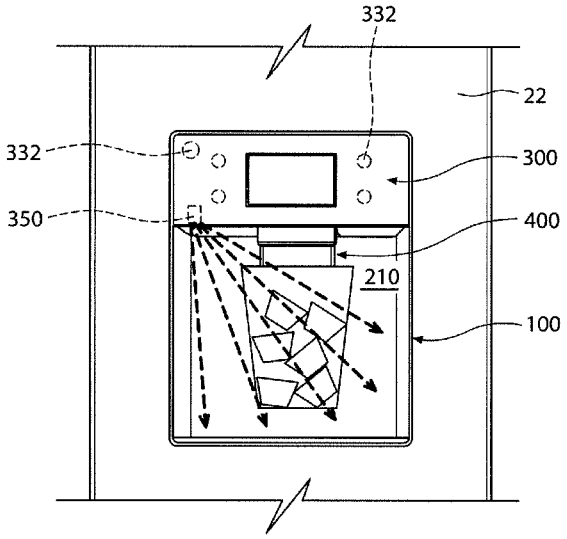

FIG. 7 is a block diagram illustrating signal flows for driving the first and second light emitting units 500 and 350 according to an embodiment. FIG. 8 is a view illustrating a state of the dispenser 100 when the first light emitting unit 500 is turned on. FIG. 9 is a view illustrating a state of the dispenser 100 when the second light emitting unit 350 is turned on.

Referring to FIGS. 1 to 9, in a state where the refrigerator 1 is powered on and is operated, if the intensity of illumination of an indoor area detected by the detection sensor 340 is equal to or greater than a set value, both the first and second light emitting units 500 and 350 of the dispenser 100 are kept in an off state. In this state, although water or ice is discharged in response to a manipulation of the manipulation member 400, the first and second light emitting units 500 and 350 are maintained in the off state.

If the intensity of illumination of the indoor area detected by the detection sensor 340 is lower than the set value (that is, if it is dark), the first light emitting unit 500 of the dispenser 100 is turned on. Then, light is emitted from the LEDs 522 toward the rear side of the manipulation member 400, that is, the rear side of the paddle 420. The light is reflected from the rear side of the manipulation member 400 so that the surrounding area of the manipulation member 400 is illuminated as shown in FIG. 8.

In this state, if a user presses the manipulation lever 410 to receive water or ice, the first light emitting unit 500 is turned off, and the second light emitting unit 350 is turned on. Then, according to the user's input displayed on the display 320, ice is discharged from the ice chute 220 or water comes out through the wafer supply pipe 230.

At this time, light is emitted from the second light emitting unit 350 toward the inside of the dispenser 100 so that the recess 210 can be illuminated. Particularly, since the inside of a cup or bowl can be illuminated when ice or water is supplied to the cup or bowl, the supply state of the ice or water can be easily checked.

After receiving a desired amount of ice or water by pressing the manipulation member 400 with the cup or bowl, the cup or bowl is taken away from the manipulation member 400.

Then, since the manipulation member 400 is not pushed, the manipulation member 400 rotates to its original position, and the second light emitting unit 350 is turned off. At the same time with this, the first light emitting unit 500 is turned on.

The manipulation member 400, the detection sensor 340, the buttons 332, the first light emitting unit 500, and the second light emitting unit 350 are electrically connected to the control unit 600 so that operations of the first and second light emitting units 500 and 350 can be determined according to a manipulation of the manipulation member 400 or an output signal of the detection sensor 340.

If necessary, the first and second light emitting units 500 and 350 may be turned on or off by manipulating the buttons 332. In addition, the first light emitting units 500 and 350 may be turned on and off according to a time set in the control unit 600.

According to the embodiments, the manipulation member of the dispenser is illuminated so that the position of the manipulation member can be easily perceived. Since the manipulation member can be easily perceived, a user can use the dispenser more conveniently.

In addition, since light is emitted from the first light emitting unit toward the rear side of the manipulation member, the surrounding area of the manipulation member can be indirectly illuminated. Therefore, the edges of the manipulation member become more distinct, and thus the manipulation member can be perceived more easily. In addition, since the sounding area of the manipulation member is illuminated, decorative effects such as mood lamp effects can be obtained.

Furthermore, the dispenser includes the first and second light emitting units. Therefore, when water or ice is not supplied, the manipulation member can be perceived more easily owing to illumination by the first light emitting unit, and when water or ice is supplied, the supply state can be easily check owing to illumination by the second light emitting unit.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet providing a storage space;

a door configured to open or close the storage space; and a dispenser disposed at a front surface of the door and configured to dispense water or ice, the dispenser including:

a dispenser case defining a recess to accommodate a container configured to receive water or ice and having a mounting part;

a manipulation member disposed in the dispenser case and including:

a paddle configured to rotate, based on being pushed by a container, from a first position to a second position to cause water or ice to be dispensed into the container, the second position being spaced in a rearward direction apart from the first position; and a transmission part transparently or semi-transparently formed in the paddle in a shape of a pattern or a character;

a first light emitting unit disposed in the mounting part of the dispenser case, the first light emitting unit being located behind the transmission part of the paddle and on a same horizontal plane of a portion of the transmission part to emit light towards the transmission part of the paddle;

a second light emitting unit disposed at an upper position in the dispenser case and configured to illuminate the recess of the dispenser case; and a control unit electrically connected to the first and second light emitting units, and configured to selectively turn on or off the first and second light emitting units based on a position of the paddle, wherein the control unit is further configured to:

determine that the paddle is in the first position; and based on a determination that the paddle is in the first position, control the second light emitting unit to be turned off and the first light emitting unit to be turned on such that a portion of the light from the first light emitting unit is transmitted through the transmission part to show the pattern or the character.

2. The refrigerator of claim 1, wherein the first light emitting unit comprises:

a light emitting unit case disposed in the dispenser case;

an L.E.D. module disposed in the light emitting unit case and comprising an L.E.D.; and a light emitting unit cover configured to cover an opened side of the light emitting unit case and to transmit light emitted from the L.E.D.

3. The refrigerator of claim 2, wherein the light emitting unit cover comprises a protrusion configured to accommodate an end part of the L.E.D. and to disperse light emitted from the L.E.D.

4. The refrigerator of claim 1, wherein the control unit is further configured to:

determine that the paddle is in the second position; and control the second light emitting unit is configured to be turned on and the first light emitting unit is configured to be turned off by the control unit based on the paddle being in the second position.

5. The refrigerator of claim 1, wherein the paddle is configured to downwardly extend a predetermined length to completely shield the first light emitting unit and is spaced in a frontward direction apart from the first light emitting unit.

6. The refrigerator of claim 1, wherein the paddle further includes a reflection part provided on a rear surface and configured to reflect the light emitted from the first light emitting unit.

7. The refrigerator of claim 1, wherein the manipulation member further includes a manipulation lever rotatably coupled to an upper end of the paddle and configured to turn on or off a switch that generates an operation signal for supplying water or ice.

8. The refrigerator of claim 1, wherein the transmission part is transparently formed in the paddle.

9. The refrigerator of claim 1, wherein the transmission part is semi-transparently formed in the paddle.

10. The refrigerator of claim 1, wherein the transmission part is formed in the paddle in the shape of the pattern, and based on the determination that the paddle is in the first position, the portion of the light from the first light emitting unit is transmitted through the transmission part to show the pattern.

11. The refrigerator of claim 1, wherein the transmission part is formed in the paddle in the shape of the character, and based on the determination that the paddle is in the first position, the portion of the light from the first light emitting unit is transmitted through the transmission part to show the character.

* * * * *